US009915263B2

(12) United States Patent
Bramberger et al.

(10) Patent No.: US 9,915,263 B2
(45) Date of Patent: Mar. 13, 2018

(54) GEAR PUMP WITH DEFLECTOR IN FLUID INTAKE FOR DIVERTING FLUID TOWARDS VOIDS IN HOUSING

(71) Applicant: Steyr Motors GmbH, Steyr (AT)

(72) Inventors: Thomas Bramberger, Kleinraming (AT); Osman Emre Arslan, Wolfern (AT); Michael Altendorfer, Steyr (AT)

(73) Assignee: Steyr Motors GmbH, Steyr (AT)

( * ) Notice: Subject to any disclaimer, the term of this patent is extended or adjusted under 35 U.S.C. 154(b) by 0 days.

(21) Appl. No.: 15/430,251

(22) Filed: Feb. 10, 2017

(65) Prior Publication Data

US 2017/0234312 A1 Aug. 17, 2017

(30) Foreign Application Priority Data

Feb. 11, 2016 (DE) ..... 10 2016 102 433

(51) Int. Cl.

| | |
|---|---|
| ***F01C 1/18*** | (2006.01) |
| ***F03C 2/00*** | (2006.01) |
| ***F03C 4/00*** | (2006.01) |
| ***F04C 2/00*** | (2006.01) |
| ***F04C 15/06*** | (2006.01) |
| ***F04C 29/12*** | (2006.01) |
| ***F04C 2/08*** | (2006.01) |
| ***F04C 2/18*** | (2006.01) |

(52) U.S. Cl.

CPC ..... *F04C 15/06* (2013.01); *F04C 2/084* (2013.01); *F04C 2/088* (2013.01); *F04C 2/18* (2013.01); *F04C 29/12* (2013.01); *F04C 2/086* (2013.01); *F04C 2210/206* (2013.01); *F04C 2240/30* (2013.01)

(58) Field of Classification Search

CPC ..... F04C 2/084; F04C 2/086; F04C 2/088; F04C 2/16; F04C 2/18; F04C 15/0049; F04C 15/06; F04C 29/0035; F04C 29/12; F04C 2240/30; F04C 2210/206

USPC ..... 418/189–190, 205, 206.1–206.9

See application file for complete search history.

(56) References Cited

U.S. PATENT DOCUMENTS

| | | | | | |
|---|---|---|---|---|---|
| 3,280,756 | A * | 10/1966 | Gordon | F04C 15/0026 | 418/132 |
| 3,575,535 | A * | 4/1971 | Bickar | F04C 2/123 | 417/244 |
| 2013/0175290 | A1* | 7/2013 | Vogt | B01F 15/0087 | 222/386 |

FOREIGN PATENT DOCUMENTS

| | | | |
|---|---|---|---|
| DE | 102015107519 | A1 | 11/2016 |
| WO | 2016180570 | A1 | 11/2016 |

* cited by examiner

*Primary Examiner* — Theresa Trieu
(74) *Attorney, Agent, or Firm* — McCoy Russell LLP

(57) ABSTRACT

In accordance with one embodiment, the gear pump comprises a first gear meshed with a second gear as well as a housing, in which the gears are supported. The housing includes a first void, which at least partly adjoins a first side surface of the first gear, and a second void, which at least partly adjoins a second side surface of the first gear. The gear pump further comprises a fluid intake channel configured to direct fluid towards the gears, wherein at least one deflector is arranged within the fluid intake such that an incident fluid flow is diverted towards the first void as well as to the second void.

33 Claims, 5 Drawing Sheets

PRIOR ART

GEAR PUMP WITH DEFLECTOR IN FLUID INTAKE FOR DIVERTING FLUID TOWARDS VOIDS IN HOUSING

CROSS-REFERENCE TO RELATED APPLICATION

This application claims priority to German Patent Application No. 10 2016 102 433.3, entitled "Gear Pump," filed on Feb. 11, 2016, the entire contents of which are hereby incorporated by reference for all purposes.

TECHNICAL FIELD

The present disclosure relates to the field of pump design, in particular to a gear pump, which may be employed as an oil pump in an internal combustion engine.

BACKGROUND

A gear pump uses the meshing of gear wheels (gears) to pump fluid through fluid displacement. Gear pumps are one of the most common types of pumps for hydraulic applications. For example, oil pumps used in internal combustion engines are usually implemented as gear pumps. Gear pumps are also widely used in chemical installations to pump highly viscous fluids. Basically, two different types of gear pumps exist, i.e. external gear pumps, which use two external spur gears, and internal gear pumps, which use an external spur gear and an internal spur gear.

As the gears rotate, the gear teeth come out of mesh on the intake side (suction side) of the pump thereby creating a void and respective suction. The void is filled by fluid, which is carried by the gears to the outlet side (pressure side) of the pump, where the meshing of the gears displaces the fluid. The mechanical clearances are small (on the order of a few 10 micrometers), and the tight clearances, along with the speed of rotation, effectively prevent the fluid from leaking back. Usually, the rigid design of the gears and the housing allows for very high pressures and the ability to pump highly viscous fluids.

External gear pumps are usually designed such that, on the intake side, the fluid (e.g. oil) flows towards the gears in a radial direction (radial inflow). In this regard the terms "radial" and "axial" refer to the rotation of the gears. Particularly when two engaged teeth of two meshed gears are about to come out of the mesh at the intake side of the pump, the above-mentioned void does not yet have a radial connection to the intake channel and path of the fluid is still blocked by the teeth of the gears. At the same time the volume between the two meshed teeth (not yet filled with fluid) becomes larger, which leads to a drop of pressure in this volume. When the two teeth finally disengage, the radial connection between the above-mentioned void and the intake suddenly opens, which may lead to an abrupt increase of local pressure and, in the worst case, to cavitation. The resulting pressure variations may impede the fluid flow into the void, deteriorate the volumetric efficiency of the pump, and increase undesired leakage. In particular, the sudden pressure drops of the opening teeth may suck oil through the small sealing gap (clearance seal) from the pressure side of the pump, which gives rise to additional leakage.

In view of the above explanation, one object of the present disclosure may be to provide a gear pump with improved efficiency. This object as achieved by the gear pump of claim

1. Various embodiments and further developments are covered by the dependent claims.

SUMMARY

A gear pump is described herein. In accordance with one embodiment, the gear pump comprises a first gear meshed with a second gear as well as a housing in which the gears are supported. The housing includes a first void, which at least partly adjoins a first side surface of the first gear, and a second void, which at least partly adjoins a second side surface of the first gear. The gear pump further comprises a fluid intake channel configured to direct fluid towards the gears, wherein at least one deflector is arranged within the fluid intake such that an incident fluid flow is diverted towards the first void as well as to the second void.

In one embodiment the deflector is shaped and positioned such that the incident fluid flow is split into a first portion and a at least a second portion, wherein the first portion of the fluid flow is diverted towards the first void and the second portion of the fluid flow is diverted towards the second void. The deflector may be shaped such that the incident fluid flow is prevented from directly flowing towards circumferential surfaces of the gears in a radial direction. The deflector may be either an integral component of the housing or a separate component that is mounted to an inner surface of the intake channel or the housing. A further deflector may be arranged such so as to guide the first portion of the fluid flow towards the first void.

The first void may be formed by a recess that is formed in an inner surface of a cover of the housing. The second void may be formed by a recess that is formed in an inner surface of the housing. Additionally or alternatively, the second void may be formed by an indentation that is formed within the intake adjacent to the second side surface of the first gear. In various embodiments, the first and the second voids are axially neighboring the gears on opposing sides of the gears.

In some embodiments the duct forming the fluid intake is slanted (not in-line) with respect to a duct forming the fluid outlet. The intake channel may be arranged at least partly in the interior of the housing. Additionally or alternatively, the intake channel may be at least partly formed by a duct externally attached to the housing.

BRIEF DESCRIPTION OF THE DRAWINGS

The present disclosure can be better understood with reference to the following description and drawings. The components in the figures are not necessarily to scale, emphasis instead being placed upon illustrating the principles of the present disclosure. Moreover, in the figures, like reference numerals designate corresponding parts. In the drawings.

DETAILED DESCRIPTION

The following description relates to an oil pump as an illustrative example of a gear pump. Such oil pumps may be used, for example, as part of the lubrication system of an internal combustion system. It is understood, however, that gear pumps implemented in accordance with the embodiments described herein may be readily used in non-automotive applications and also used to pump fluids other than oil.

Figure 1:
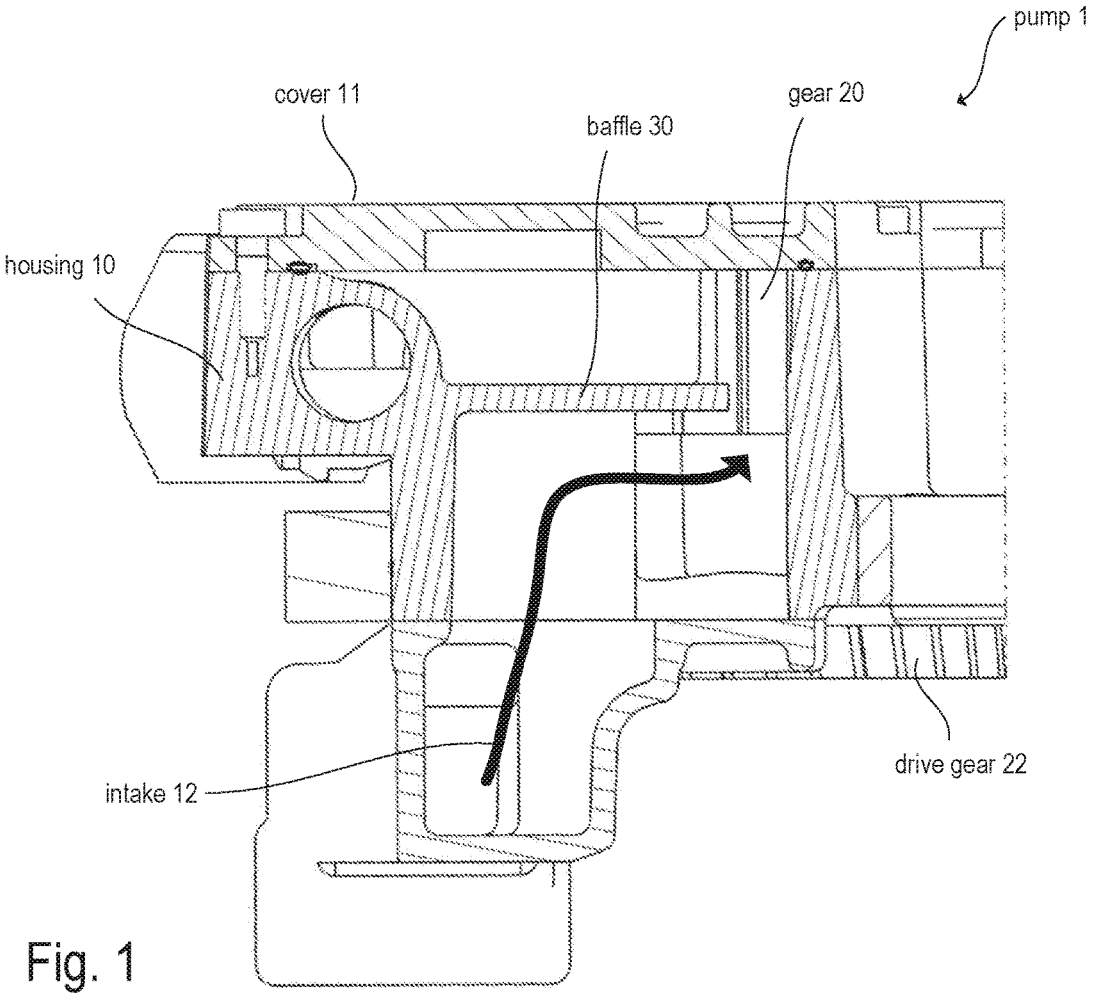
FIG. 1 illustrates an isometric sectional view of an exemplary gear pump.

FIG. 1 illustrates one exemplary gear pump 1, which may be employed to pump oil, for example, from an oil reservoir to the cylinder heads of an internal combustion engines. FIG. 1 illustrates the housing 10 of the gear pump, which includes the housing cover 11. FIG. 1 is a sectional view through the intake portion of the pump so that the interior of the intake channel 12 is visible as well as one of the two gear wheels (first gear 20) that are supported within housing 10. In the duct forming the intake channel 12 of the pump a baffle 30 is provided which directs the inflowing oil towards the gears. The arrow schematically indicates the direction of the inflowing oil. Due to the baffle, the oil reaches the gears partly (in a substantial axial direction) at the lower side surfaces of the gears and partly (in a substantial radial direction) at the circumferential side of the gears.

Figure 2:
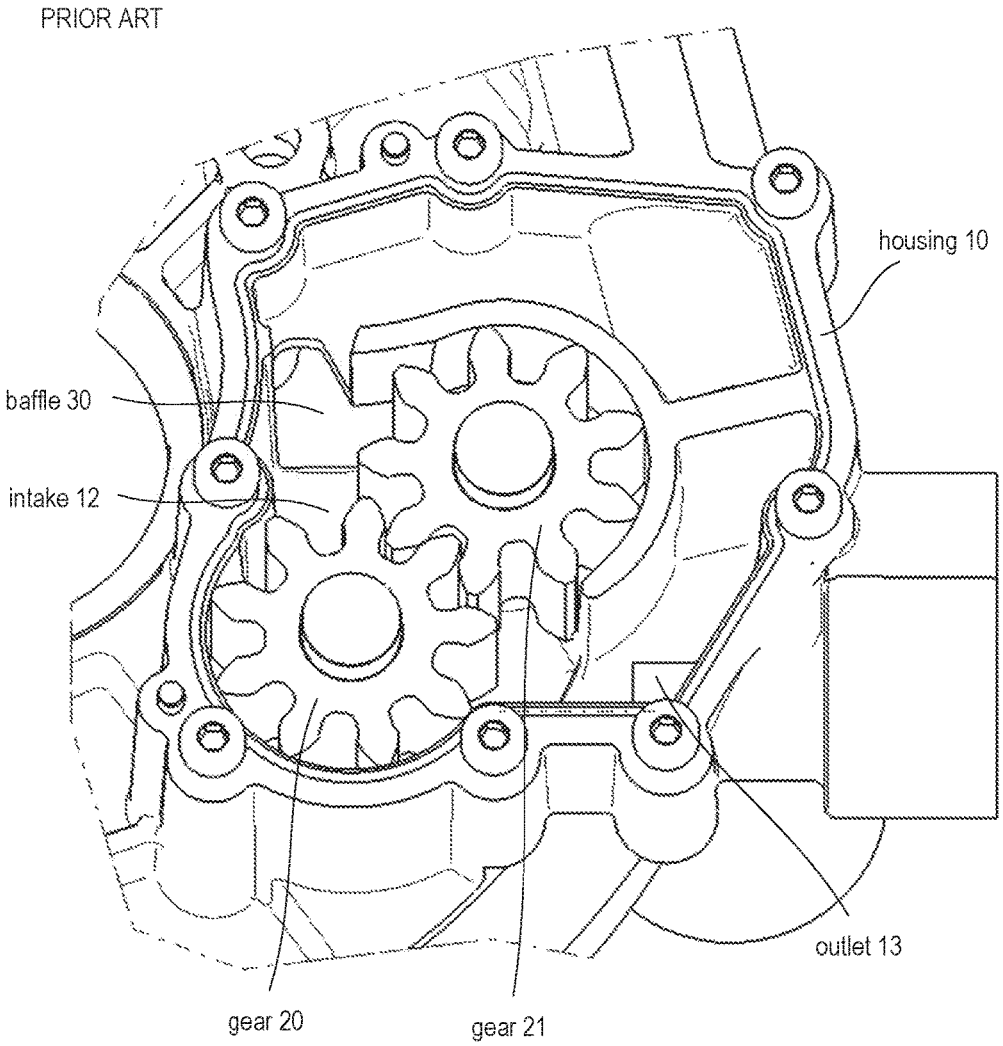
FIG. 2 illustrates another section view of the gear pump of FIG. 1.

FIG. 2 illustrates another sectional view of the exemplary pump shown in FIG. 1. In FIG. 2, the cover 11 has been removed to allow a top view into the housing 10 of the gear pump 1. FIG. 2 shows the two meshed gears (first gear 20 and second gear 21) as well as a portion of the duct forming the outlet 13 on the pressure side of the pump. As mentioned above, when two engaged teeth of the gears 20, 21 disengage, a sudden pressure drop may occur giving rise to increased leakage and reduced efficiency. Furthermore, the baffle 30 (see also FIG. 1) creates a kind of "bottleneck" that throttles the cross sectional area available for the oil to pass through towards the gears. In addition to this, the oil flow next to the gears (i.e. in the void 15 under the lower side surface of gear 20) may give rise to turbulences caused by the countermotion of the oil stream as compared to the gear motion.

To improve the situation, the duct forming the oil intake channel 12 may be designed such that the inflowing oil is diverted into voids, which are located axially right and left of at least one of the gears 20, 21. The mentioned diverting is accomplished by a deflector or a system of deflectors arranged within the intake channel 12 of the gear pump. The voids may be formed by recesses in the cover 11 and the housing 10. At least one of the voids may be formed by an indentation in the intake channel 12 adjacent to a side surface of the gear 20. The deflector diverts the incident oil flow towards the mentioned voids thereby, firstly, generating a dynamic pressure within the voids and, secondly, preventing the incident oil flow from directly reaching the circumferential surface of the gears 20, 21 from a radial direction.

Figure 3:
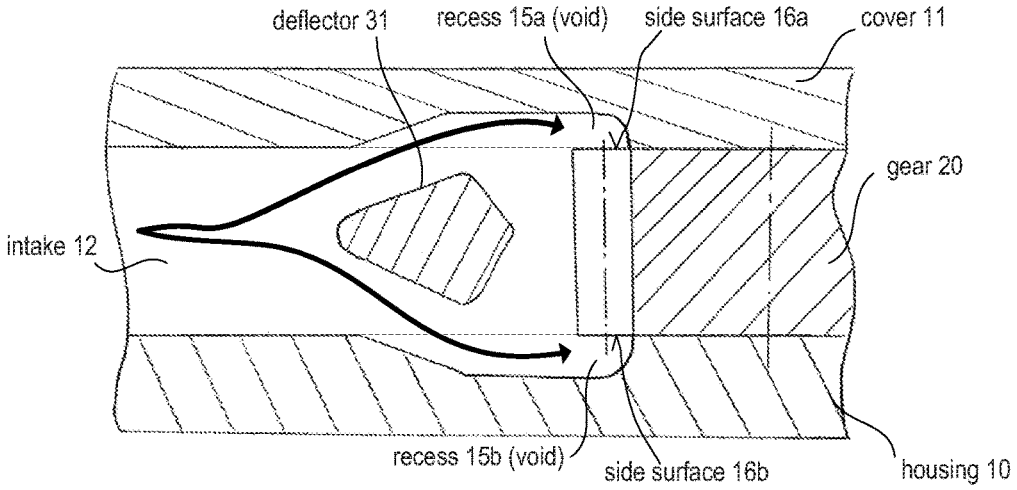
FIG. 3 schematically illustrates a first embodiment of a gear pump, the illustration shows the intake side of a gear pump, wherein the fluid passes the intake substantially in a radial direction.

FIG. 3 illustrates one simple exemplary embodiment implementing the concept explained above. FIG. 3 is a cross-sectional view illustrating a gear 20 of a gear pump supported in a housing 10 with a removable housing cover 11. The duct forming the oil intake channel 12 extends essentially in a radial direction (perpendicular to the rotation axis of the gears). A first recess 15*a* is provided in the cover 11 and a second recess 15*b* is provided in the housing 10. Both recesses form voids which are located (when looking in a radial direction) left and right of the gear 20 and at least partially adjoining the lower (left) and the upper (right) side surface 16*a*, 16*b* of the gear 20. A deflector 31 is arranged within the intake channel 12. As mentioned, the deflector 31 is designed such that it diverts the (radially) incident oil flow towards the voids formed by the recesses 15*a* and 15*b* thereby creating a dynamic pressure in the voids on both sides of the gears (i.e. axially above and axially below the gears).

Figure 4:
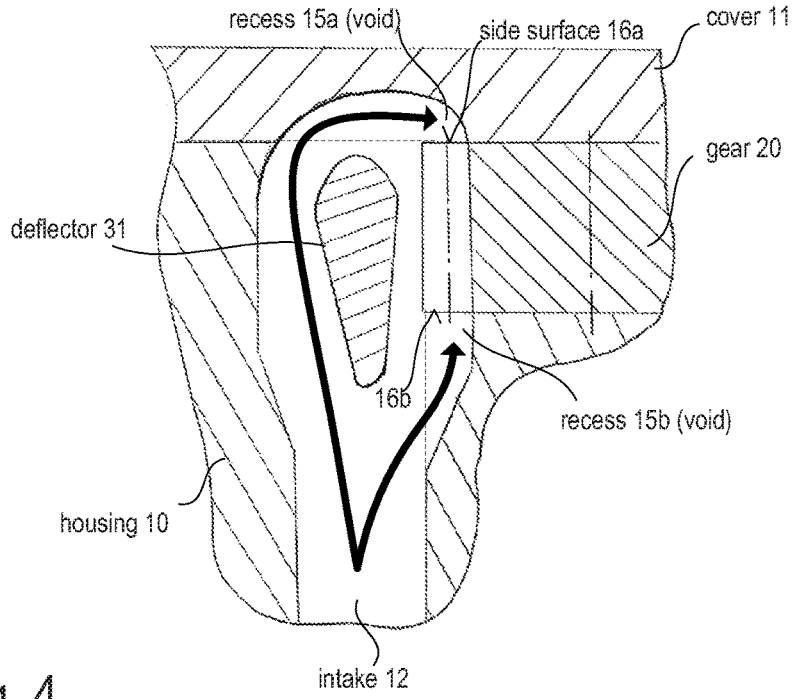
FIG. 4 schematically illustrates a second embodiment of a gear pump, the illustration shows the intake side of a gear pump, wherein the fluid passes the intake substantially in an axial direction.

FIG. 4 illustrates another simple embodiment implementing the concept explained above. FIG. 4 is a cross-sectional view illustrating a gear 20 of a gear pump supported in a housing 10 with a removable housing cover 11. As opposed to the previous example of FIG. 3, the duct forming the oil intake channel 12 extends essentially in an axial direction (parallel to the rotation axis of the gears). Similar to the previous example, a first recess 15*a* is provided in the cover 11 and a second recess 15*b* is provided in the housing 10, wherein both recesses form voids which at least partly adjoin the side surfaces 16*a*, 16*b* of the gear 20 (and the second gear 21 not shown in FIG. 4). The second recess 15*b* may also be regarded as an indentation in the intake channel 12 adjacent to the side surface 16*b* of the gear 20. A deflector 31 is arranged within the intake channel 12 and, in the present example, the deflector 31 is designed such that it diverts the (axially) incident oil flow towards the voids formed by the recesses 15*a* and 15*b*. The effect of the deflector is practically the same as in the previous example of FIG. 3. In both cases, the incident oil flow is "split" into two portions, one of which being diverted to the first recess 15*a* whereas the other one is diverted to the second recess 15*b*.

Figure 5A:
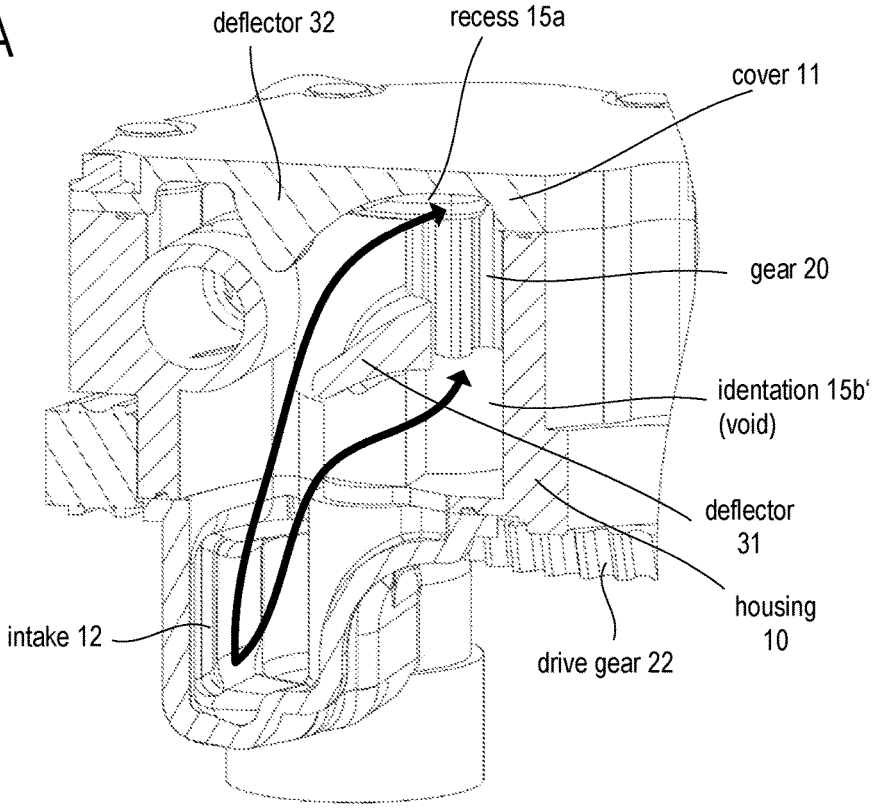
FIG. 5A illustrates an isometric sectional view of a third embodiment of a gear pump.
Figure 5B:
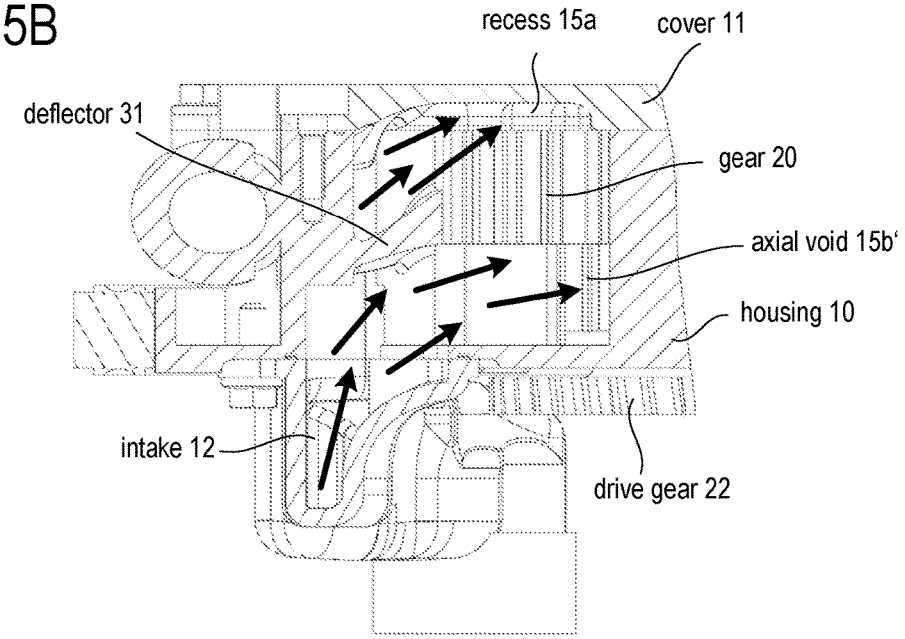
FIG. 5B illustrates a further sectional view of a third embodiment of a gear pump.

FIG. 5 illustrates another exemplary gear pump implementing the concept described herein. FIGS. 5A and 5B are different sectional views (with regard to different sectional planes) of the same embodiment. In both views the sectional plane runs through the intake channel 12 of the pump in order to visualize the interior of the intake channel 12. Accordingly, FIG. 5 shows the gear 20 supported in the housing 10 that includes cover 11. The drive gear 22 is arranged outside the housing 10 and mechanically coupled to the gear 20. Similar to the previous examples a recess 15*a* is provided in the inner surface of the cover 11 to form a void that at least partially adjoins the upper side surface of the gear 20 (i.e. the void is axially above the gear 20). An indentation 15*b*' forms a further void in the intake channel 12 in the interior of the housing 10. The further void adjoins the lower surface of the gear 20 (i.e. the void is axially below the gear 20). Similar to the previous examples, at least one deflector 31 is arranged in the intake channel 12. In the present example a first deflector 31, which is arranged in the lower part of the intake channel 12, is designed to split the incident oil flow into two portions, wherein a first (lower) portion of the incident oil flow is diverted to the void 15*b*' along the lower surface of the deflector 31 and wherein the second (upper) portion of the incident oil flow is diverted to the recess 15*a* along an upper surface of the deflector 31. According to the present example, a further deflector 32 is arranged on the inner surface of the cover 11. The deflector 32 is shaped such the upper portion of the incident oil flow is efficiently guided to the recess 15*a* above the gears 20, 21 without causing too much turbulence.

In the examples describes herein, the first deflector 31 is arranged in the fluid intake channel 12 of the gear pump, wherein the fluid intake channel 12 is in the interior of the housing 10. That is, the duct forming the fluid intake channel 12 on the suction side of the pump is mainly formed by the specific shaping of the interior of the housing 10. However, it is understood that, in general, at least a part of the fluid intake may be formed by a separate component, which is external to the housing 10 and attached to the housing 10 during assembly of the gear pump.

In all embodiments, the deflector 31 may be an integral portion of the housing 10. The housing may be made of, for example cast iron or cast aluminum. That is, deflector 31 and the main part of the housing 10 may be one piece. The recesses 15*b* or the indentation 15*b*' forming the void in the intake channel 12 may either be made by using an appropriately shaped casting mold or using a subsequent abrasive machining process, for example by milling the recess into the cast housing 10. Alternatively, the deflector 31 may be a separate component which is mounted in the intake channel 12 of the gear pump during assembly. Thereby the deflector 31 may be screwed, welded or glued to an inner surface of the intake channel 12. Generally, the deflector 31 itself may be one piece or composed of two or more pieces which are joined to form the deflector 31. In any embodiment the deflector may have any geometric shape and mounted in any position, provided that the shape and the position of the deflector 31 are such that the incident fluid flow is split into a first portion and a at least a second portion, wherein the first portion of the fluid flow is diverted towards the first void (recess 15*a*) and the second portion of the fluid flow is diverted towards the second void (recess 15*b* or indentation 15*b*', see FIGS. 3 to 6).

Figure 6:
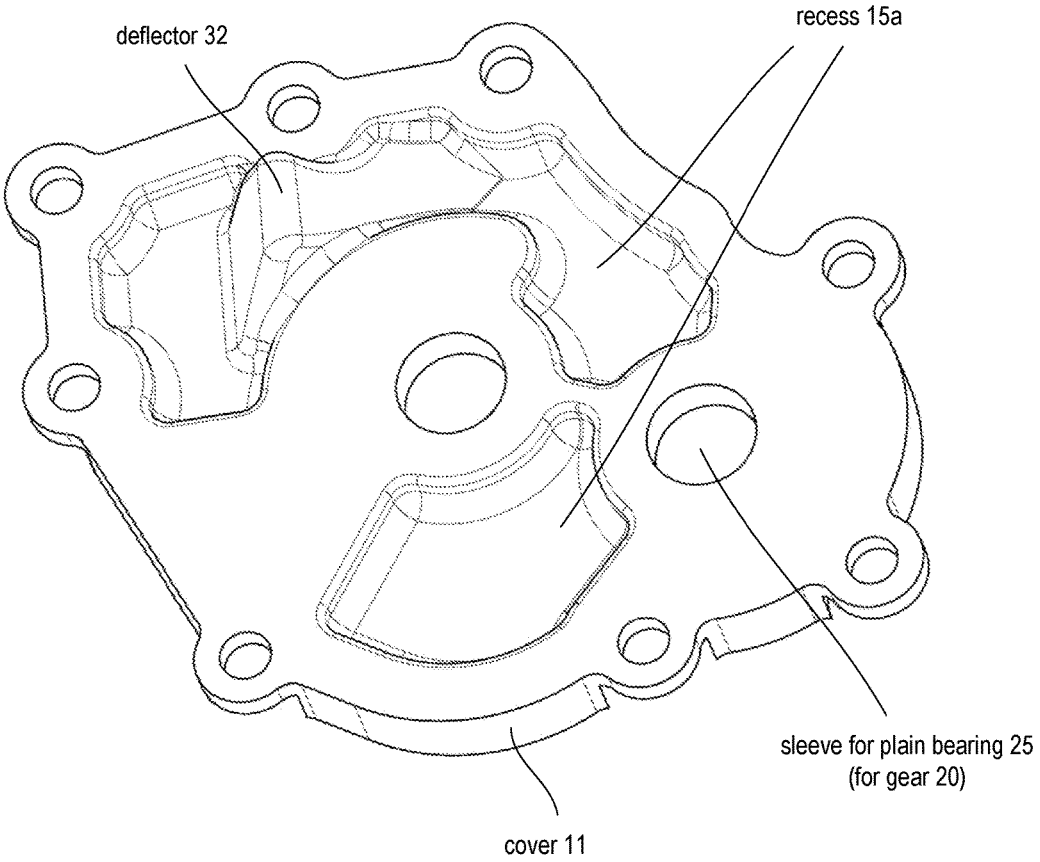
FIG. 6 illustrates the cover of the pump housing of the embodiments of FIGS. 5A and 5B.

FIG. 6 illustrates one example of the cover 11. As can be seen in FIG. 6, the inner surface of the cover 11 may include sleeves, which form parts of plain bearings 25, 26 of the gears 20, 21, respectively. The inner surface of the cover 11 further includes the recess 15*a* forming the void axially above the gears 20, 21 (see FIG. 5B). Furthermore, FIG. 6 illustrates the second deflector 32 arranged on the inner surface of the cover 11. In the present example, the deflector 32 is an integral part of the cover 11, wherein cover 11 and deflector 32 are produced in one piece. For example the cover 11 as well as the body of the housing 10 may be made of cast iron or cast aluminum. The recess 15*a* may, however, also be produced by a subsequent abrasive machining process, for example by milling the recess into the cast cover 11.

Although the present disclosure has been illustrated and described with respect to one or more implementations, variations and/or modifications may be made to the illustrated examples without departing from the spirit and scope of the appended claims. In particular regard to the various functions performed by the above described components or structures (units, assemblies, devices, circuits, systems, etc.), the terms (including a reference to a "means") used to describe such components are intended to correspond—unless otherwise indicated—to any component or structure which performs the specified function of the described component (e.g., that is functionally equivalent), even though not structurally equivalent to the disclosed structure, which performs the function in the herein illustrated exemplary implementations of the present disclosure.

In addition, while a particular feature of the present disclosure may have been disclosed with respect to only one of several implementations, such feature may be combined with one or more other features of the other implementations as may be desired and advantageous for any given or particular application. Furthermore, to the extent that the terms "including", "includes", "having", "has", "with", or variants thereof are used in either the detailed description and the claims, such terms are intended to be inclusive in a manner similar to the term "comprising".

The invention claimed is:

1. A gear pump comprising:

a first gear meshed with a second gear;

a housing, in which the gears are supported, wherein the housing includes a first void, which at least partly adjoins a first side surface of the first gear, and a second void, which at least partly adjoins a second side surface of the first gear, and wherein the first void is formed by a recess formed in an inner surface of a cover of the housing;

a fluid intake channel configured to direct fluid towards the gears; and at least one deflector arranged within the fluid intake channel such that an incident fluid flow is diverted towards the first void as well as to the second void.

2. The gear pump according to claim 1, wherein the deflector is shaped and positioned such that the incident fluid flow is split into a first portion and at least a second portion, wherein the first portion of the fluid flow is diverted towards the first void and the second portion of the fluid flow is diverted towards the second void.

3. The gear pump according to claim 2, further comprising a further deflector arranged such so as to guide the first portion of the fluid flow towards the first void.

4. The gear pump according to claim 1, wherein the second void is formed by a recess formed in an inner surface of the housing.

5. The gear pump according to claim 1, wherein the second void is formed by an indentation formed within the fluid intake channel adjacent to the second side surface of the first gear.

6. The gear pump according to claim 1, wherein the first and second voids are axially neighboring the gears on opposing sides of the gears.

7. The gear pump according to claim 1, wherein the deflector is shaped such that the incident fluid flow is prevented from directly flowing towards circumferential surfaces of the gears in a radial direction.

8. The gear pump according to claim 1, further comprising a fluid outlet, wherein a duct forming the fluid intake channel is slanted with respect to a duct forming the fluid outlet.

9. The gear pump according to claim 1, wherein the deflector is an integral component of the housing.

10. The gear pump according to claim 1, wherein the deflector is a separate component mounted to an inner surface of the fluid intake channel or the housing.

11. The gear pump according to claim 1, wherein the fluid intake channel is arranged at least partly in an interior of the housing or wherein the fluid intake channel is at least partly formed by a duct externally attached to the housing.

12. A gear pump comprising:

a first gear meshed with a second gear;

a housing, in which the gears are supported, wherein the housing includes a first void, which at least partly adjoins a first side surface of the first gear, and a second void, which at least partly adjoins a second side surface of the first gear, and wherein the first and second voids are axially neighboring the gears on opposing sides of the gears;

a fluid intake channel configured to direct fluid towards the gears; and at least one deflector arranged within the fluid intake channel such that an incident fluid flow is diverted towards the first void as well as to the second void.

13. The gear pump according to claim 12, wherein the deflector is shaped and positioned such that the incident fluid flow is split into a first portion and at least a second portion, wherein the first portion of the fluid flow is diverted towards the first void and the second portion of the fluid flow is diverted towards the second void.

14. The gear pump according to claim 13, further comprising a further deflector arranged such so as to guide the first portion of the fluid flow towards the first void.

15. The gear pump according to claim 12, wherein the first void is formed by a recess formed in an inner surface of a cover of the housing.

16. The gear pump according to claim 12, wherein the second void is formed by a recess formed in an inner surface of the housing.

17. The gear pump according to claim 12, wherein the second void is formed by an indentation formed within the fluid intake channel adjacent to the second side surface of the first gear.

18. The gear pump according to claim 12, wherein the deflector is shaped such that the incident fluid flow is prevented from directly flowing towards circumferential surfaces of the gears in a radial direction.

19. The gear pump according to claim 12, further comprising a fluid outlet, wherein a duct forming the fluid intake channel is slanted with respect to a duct forming the fluid outlet.

20. The gear pump according to claim 12, wherein the deflector is an integral component of the housing.

21. The gear pump according to claim 12, wherein the deflector is a separate component mounted to an inner surface of the fluid intake channel or the housing.

22. The gear pump according to claim 12, wherein the fluid intake channel is arranged at least partly in an interior of the housing or wherein the fluid intake channel is at least partly formed by a duct externally attached to the housing.

23. A gear pump comprising:

a first gear meshed with a second gear;

a housing, in which the gears are supported, wherein the housing includes a first void, which at least partly adjoins a first side surface of the first gear, and a second void, which at least partly adjoins a second side surface of the first gear, a fluid intake channel configured to direct fluid towards the gears; and at least one deflector arranged within the fluid intake channel such that an incident fluid flow is diverted towards the first void as well as to the second void, wherein the deflector is shaped such that the incident fluid flow is prevented from directly flowing towards circumferential surfaces of the gears in a radial direction.

24. The gear pump according to claim 23, wherein the deflector is shaped and positioned such that the incident fluid flow is split into a first portion and at least a second portion, wherein the first portion of the fluid flow is diverted towards the first void and the second portion of the fluid flow is diverted towards the second void.

25. The gear pump according to claim 24, further comprising a further deflector arranged such so as to guide the first portion of the fluid flow towards the first void.

26. The gear pump according to claim 23, wherein the first void is formed by a recess formed in an inner surface of a cover of the housing.

27. The gear pump according to claim 23, wherein the second void is formed by a recess formed in an inner surface of the housing.

28. The gear pump according to claim 23, wherein the second void is formed by an indentation formed within the fluid intake channel adjacent to the second side surface of the first gear.

29. The gear pump according to claim 23, wherein the first and second voids are axially neighboring the gears on opposing sides of the gears.

30. The gear pump according to claim 23, further comprising a fluid outlet, wherein a duct forming the fluid intake channel is slanted with respect to a duct forming the fluid outlet.

31. The gear pump according to claim 23, wherein the deflector is an integral component of the housing.

32. The gear pump according to claim 23, wherein the deflector is a separate component mounted to an inner surface of the fluid intake channel or the housing.

33. The gear pumps according to claim 23, wherein the fluid intake channel is arranged at least partly in an interior of the housing or wherein the fluid intake channel is at least partly formed by a duct externally attached to the housing.

* * * * *